United States Patent [19]

Vöhringer

[11] Patent Number: 4,998,568

[45] Date of Patent: Mar. 12, 1991

[54] DOUBLE LAYERED PAPERMAKING FABRIC WITH HIGH PAPER SIDE CROSS THREAD DENSITY

[75] Inventor: Fritz Vöhringer, Heidenheim, Fed. Rep. of Germany

[73] Assignee: F. Oberdorfer GmbH & Co. KG Industriegewebe-Technik, Heidenheim, Fed. Rep. of Germany

[21] Appl. No.: 179,564

[22] Filed: Apr. 8, 1988

[30] Foreign Application Priority Data

Apr. 22, 1987 [DE] Fed. Rep. of Germany ..... 3713510

[51] Int. Cl.[5] ..... D21F 7/10

[52] U.S. Cl. ..... 139/383 A; 139/413

[58] Field of Search ..... 139/383 A, 425 A, 413

[56] References Cited

U.S. PATENT DOCUMENTS

| | | | |
|---|---|---|---|
| 4,499,927 | 2/1985 | Borel | 139/425 A |
| 4,564,051 | 1/1986 | Odenthal | 139/383 A |
| 4,739,803 | 4/1988 | Borel | 139/383 A |
| 4,776,373 | 10/1988 | Borel | 139/383 A |

*Primary Examiner*—Andrew M. Falik

*Attorney, Agent, or Firm*—Gifford, Groh, Sprinkle, Patmore and Anderson

[57] ABSTRACT

A papermaking wire of double layered fabric, consisting of a set of warp threads, yarns in machine direction, and a set of weft threads on the running side of the wire, yarns in cross machine direction, as well as a set of weft threads on the paper side of the wire, the last one consisting of at least two groups of weft threads differing from one another with respect to the outwardly located length of floatings. In order to avoid an unacceptable decrease of the stability of the wire and avoid markings in the paper as well as an essential reduction of drainage of the wire, if the number of cross threads on the paper side is increased, the wire is configurated such that it includes three groups of cross threads A, B, C on the paper side. Within one weave pattern each warp thread is transversing three weft threads succeeding one another on the paper side and running thereafter between the weft threads on the paper side and on the running side interlacing at least one weft thread on the running side. Thereafter, the warp thread crosses below three cross threads, succeeding one another on the paper side and thereafter crossing over three crossthreads succeeding one another on the paper side.

15 Claims, 3 Drawing Sheets

DOUBLE LAYERED PAPERMAKING FABRIC WITH HIGH PAPER SIDE CROSS THREAD DENSITY

BACKGROUND OF THE INVENTION

1. Field of the Invention

The present invention relates generally to papermaking conveyor belts or "wires" and, more particularly, to a papermaking wire comprising a weave pattern for a smoother paper and more durable wire.

2. Description of the Prior Art

For the manufacturing of paper, conveyor belts are used to feed the pulp suspension to the press equipment. These belts are termed "papermaking wires" and are formed from woven strands of "yarn" or "wire".

The pulp suspension is dried while being transported on the papermaking wire to the press equipment. In order to aid the pulp drying process, the papermaking wire must be permeable, therefore, the weave pattern of the wire is important.

A longitudinal yarn or wire is called a warp yarn. A horizontal or crossweave is called a weft yarn. The weave pattern is formed from the interweaving to warp and weft yarns. A "knuckle" is formed where a warp yarn passes over or under one weft yarn or where a weft yarn passes over or under one warp yarn. A "float" is where a warp yarn travels over or under two or more weft yarns or a weft yarn passes over or under two or more warp yarns.

The wire has an upper face which comes in contact with the pulp suspension, the paper side, and a lower face which comes in contact with the conveyor rollers, the machine side. The running side refers to the weft threads on the machine side. Thus, the wire must be permeable to aid in the drying of the pulp suspension as it travels to the paper press, and durable to withstand the wear from the conveyor rollers. The weave pattern of the wire, therefore, is directly related to the permeability and durability of the wire.

To create a permeable wire, and a smoother paper, it is desirable to have floats on the paper side of the weave pattern. To create durability it is also desirable to have floats on the machine side as the knuckles protrude from the wire and wear against the conveyor rollers. However, if a weave has too many floats on either the paper side or machine side the wire will tend to curve, creating a rolled paper edge or thinned paper edge respective of which side the wire is curving towards.

In order to maintain maximum permeability and durability, it has been found necessary to increase the number of meshes, or open spaces in the weave, per square centimeter area of the wire. Increasing the meshes simultaneously creates a uniform fiber while decreasing the potential markings caused by the wire in the drying pulp.

Increasing the amount of meshes has resulted in refining the wire or yarns. Such refining, however, is limited where decreasing the diameter of the wire directly decreases the durability of the wire. Therefore, a tradeoff must be made between the smoothness of the paper and the useful life of the papermaking wire.

SUMMARY OF THE INVENTION

Accordingly, it is the object of the present invention to provide a papermaking wire or fabric, having an increased number of cross threads on the paper side, but no drawbacks of the above mentioned kind, especially no unacceptable decrease of stability of the wire and no marking of the paper.

It is another object of the present invention to provide such a papermaking wire having excellent warp and weft stability and long service life.

These and other objects are solved by a structure of the wire which is characterized in that there are three groups of cross threads or weft threads A, B, C on the paper side and that within a weave pattern each warp thread is crossing over three succeeding weft threads, A, B, C, on the paper side, thereafter crossing below three succeeding weft threads on the paper side, thereafter crossing over three succeeding weft threads on the paper side and after that extending between the weft threads on the paper side and the machine side, simultaneously interlacing at least one weft thread on the machine side.

An extremely great number of weft threads are gained on the paper side because of their frequency and related location within the weave pattern. On the other hand, the feature that at those points in which three succeeding weft threads on the paper side which are distantly separated from one another, are crossed below by a warp thread, the permeability of the wire is maintained to a sufficient extent despite the extremely great number of weft threads. From the above follows that the longitudinal floatings as well as the cross floatings of the paper side are located nearly in the same plane and are distributed in that plane very favorably, and that is one of the reasons why the drawback of an increased likelihood of marking is avoided in the papermaking wire according to the invention.

In comparison to the known double layered papermaking wire shown in FIG. 2 of the drawings in cross section, the paper side of which is formed of two groups of cross threads E, F, the wire according to the invention is provided on the basis of the same number of longitudinal threads per cm but having at least a 15% greater number of cross threads per cm on the paper side as well as on the running side. In comparison with a known double layered papermaking wire shown in FIG. 1 in cross section, all cross threads of which on the paper side having the same type of binding, the wire according to the invention is provided on the basis of the same number of longitudinal threads per cm but having at least an 80% greater number of cross threads per cm on the paper side than that of the known wire.

DESCRIPTION OF THE DRAWINGS

A better understanding of the invention will be reached by reference to the following detailed description when read in conjunction with the accompanying drawings in which.

DETAILED DESCRIPTION OF THE PREFERRED EMBODIMENT OF THE INVENTION

Figure 3:
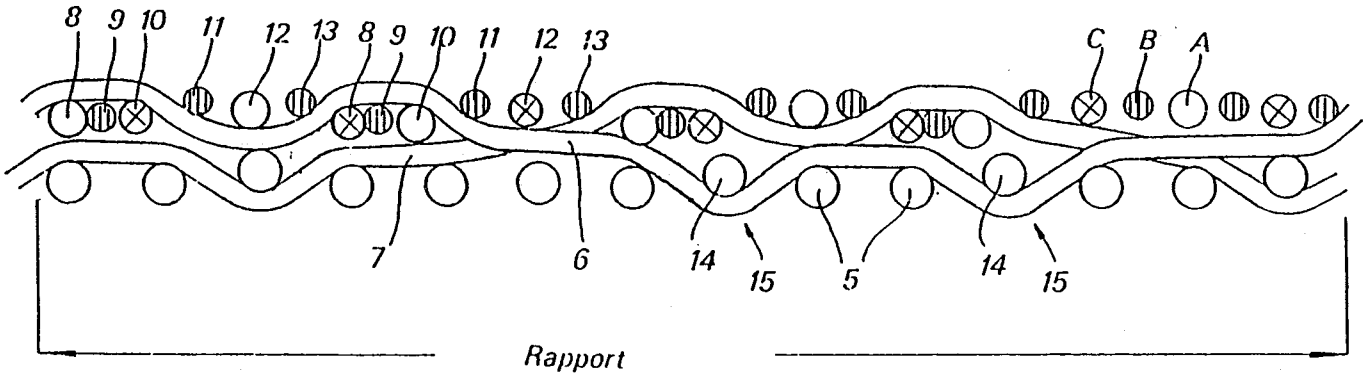
FIG. 3 is a schematical view of one embodiment of the papermaking wire according to the invention in form of a cross section thereof of a complete length of the weave pattern.
Figure 4:
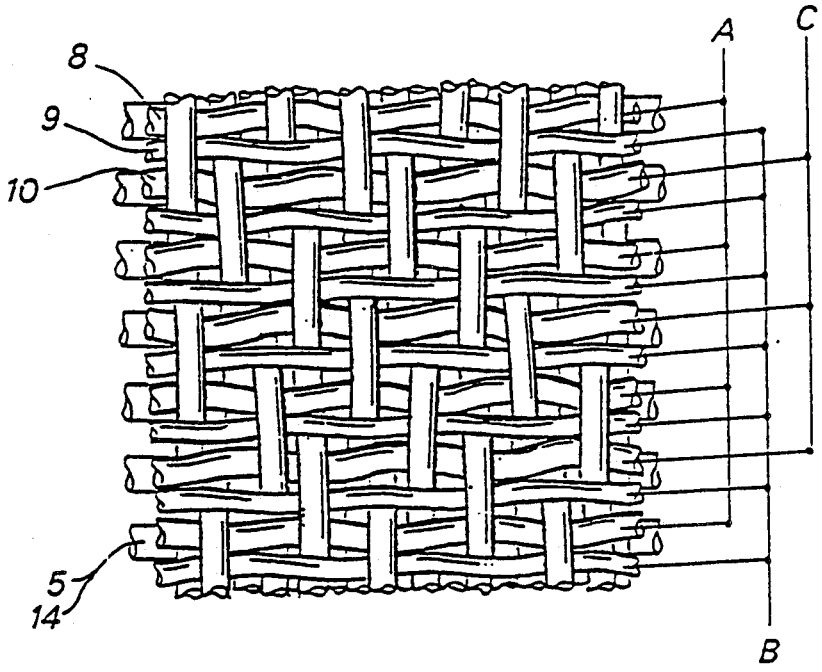
FIG. 4 is a schematical plan view of a detail of the wire of FIG. 3 from the paper side thereof.

The paper making wire according to the invention as shown in FIGS. 3 and 4 consists of a double layered wire having a weave pattern provided with seven longitudinal or warp threads 61–67 and forty-two cross or weft threads 41–98. The drawing of FIG. 3 shows the extension of two adjacent warp threads 61 and 62, which are displaced with respect to one another by twelve or sixteen weft threads, respectively, on the paper side. Therefore the warp threads 61–67 are interwoven in a twelve thread pattern with weft threads 71–82 first and then form a sixteen thread pattern with weft threads 83–98. The pattern is then repeated whereby the warp threads 61–67 are interwoven with the twelve series weft threads 71–82, then interwoven with the sixteen series weft threads 83–98. Moreover, the warp threads 61–67 are also repeated as a series of seven threads. Further, each series of three weft threads, 71–73, 74–76, 77–79, 80–82, for example, differ from one another with respect to their diameters and/or material characteristics as well as in the length of the floatings. These differences are shown as A, B, C in FIG. 3. Therefore, weft threads 71–73 comprise a group of threads A, B, C, whereas in weft threads 77–79, 77 and 79 are comprised of group B weft threads and 78 is formed from weft threads A or C, respectively.

As can be gathered from the drawings in FIGS. 3 and 4, within the weave pattern there are on the paper side three groups of weft threads A, B and C, and each warp thread 61 and 62 is shown crossing over the three weft threads 71, 72, 73, succeeding one another on the paper side, thereafter crossing under three further weft threads 74, 75, 76 succeeding one another on the paper side and thereafter crossing over the following three weft threads 77, 78, 79 on the paper side, extending thereon between the weft thread set on the paper side and the running side, and interlacing with two weft threads 48, 51 on the running side which are not succeeding one another and which can also be located in another position. The weft threads 71, 72 73 on the paper side are very closely positioned so that they contact one another. Each of these three weft threads differs from the other two with respect to the length of its floatings (FIG. 4), and with respect to its diameter and/or its material. The weft threads 74, 75, 76 following weft threads 71, 72, 73 are distantly separated from one another (FIG. 3), each belonging to only two different groups of threads, the structure being such that the two weft threads 74 and 76 are identical to one another with respect to their diameters, but may differ from the third weft thread 75 with respect to their material and/or their diameter.

According to FIG. 3, each warp thread 61–67 may be interlaced by two weft threads 41, 42 on the running side which are not closely positioned or succeeding one another, and each of these warp threads may be interlaced within the weave pattern by only one warp thread. As can be gathered from FIG. 3, the warp threads are interlaced two times by the lower layer of weft threads, creating a knuckle. Between both interlacing points or knuckles 48, 51 an outwardly directed force component is provided forcing the weft threads 49, 50 positioned between those two interlacing points outwardly, if the wire is exposed to longitudinal tensions during the fixation process of the wire. This is the reason why an excellent papermaking wire of the cross thread runner-type is provided according to the invention.

FIG. 4 shows a detailed view of the paper side of the wire according to the invention in order to illustrate the difference of the floating lengths of the three groups of weft threads A, B, C, as well as their frequency and distribution.

Figure 1:
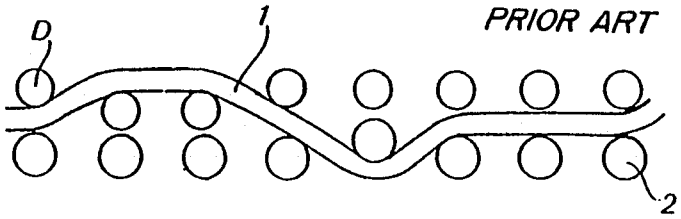
FIG. 1 is a cross section of a known double layered papermaking wire provided with only one group of cross threads on the paper side.
Figure 2:
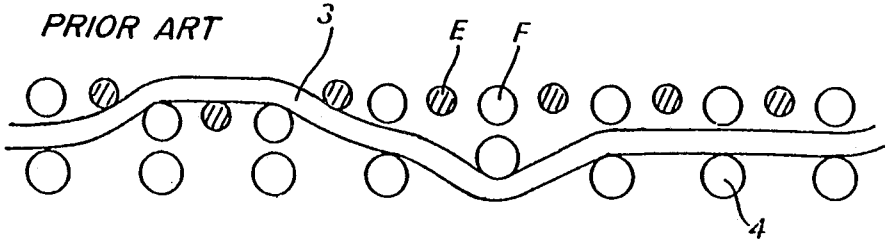
FIG. 2 is a cross section of a further known double layered wire provided with two groups of cross threads on the paper side.

For special applications in which great permeability is required, for instance in the manufacture of tissue-fabrics, the number of weft threads may be diminished in usual manner in order to gain the required permeability The following table compares the characterizing features of the wires according to the invention with those features of the known wires as shown by FIGS. 1 and 2 on the basis of the same numbers of warp threads per cm and diameters of the warp threads in mm.

Table for Comparison

| | Prior art wires | | wires according to the invention |
|---|---|---|---|
| | FIG. 1 | FIG. 2 | FIG. 3 |
| Number of the groups of weft threads on the paper side | 1 | 2 | 3 |
| Number of the warp threads/cm | 62 | 62 | 62 |
| Diameter of the warp threads (mm) | 0.17 | 0.17 | 0.17 |
| Number of the weft threads on the paper side per cm | 24 | 36 | 44 |
| Number of the weft threads on the running side per cm | 24 | 18 | 22 |
| Diameter of the weft threads on the running side (mm) | 0.20 | 0.20 | 0.22 |
| Number of the fiber supporting longitudinal and cross floatings per cm on the paper side | 425 | 478 | 585 |
| Porosity for air $\frac{1}{m^2 \cdot s}$ | 2200 | 2500 | 2300 |
| Number of the diagonals per cm consisting of longitudinal or cross floatings of the paper side | 15 | 13 | 17 |

The number of diagonals per cm consisting of longitudinal floatings or cross floatings of the paper side or the distances thereof from one another is the measure for the ability of forming markings. The likelihood for the appearance of undesired wire markings in the paper increases with the increase in distance between the diagonals or, put another way, the decrease in the number of diagonals overall.

The number of weft threads per cm on the paper side is, in the known wires, essentially smaller than in the wire according to the invention, so that in comparison with the finest wires of the prior art the stability of the wire according to the invention has essentially been increased with the consequence that under operating conditions on the papermaking machine the extreme tension loads and wear occurrances are essentially longer sustained.

Figure 5:
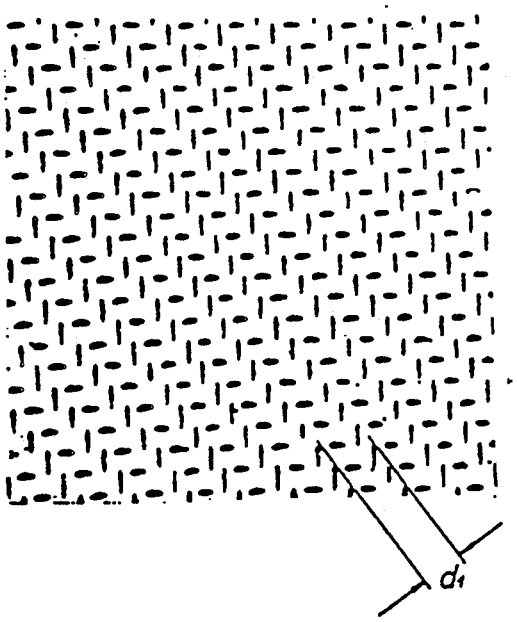
Fig.5 PRIOR ART
FIG. 5 is an impression of the paper side of the known wire according to FIG. 1.
Figure 6:
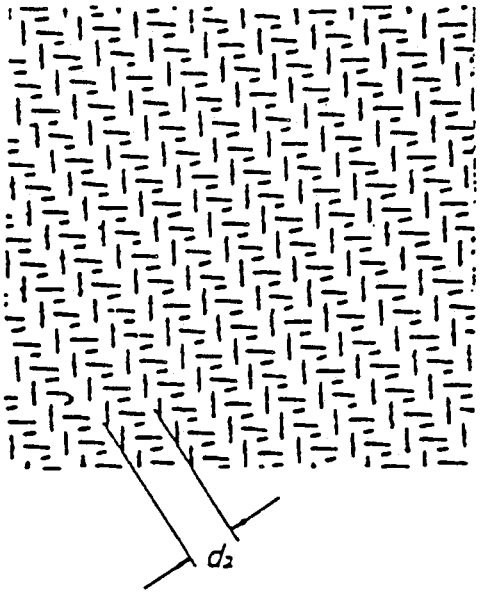
Fig.6 PRIOR ART
FIG. 6 is an impression of the paper side of a known wire according to FIG. 2
Figure 7:
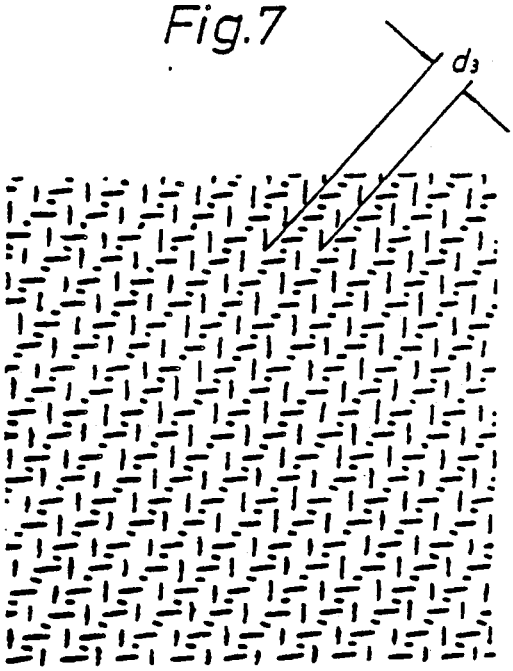
FIG. 7 is an impression of the paper side according to the wire of the invention as shown in FIGS. 3 and 4.
Figure 1:
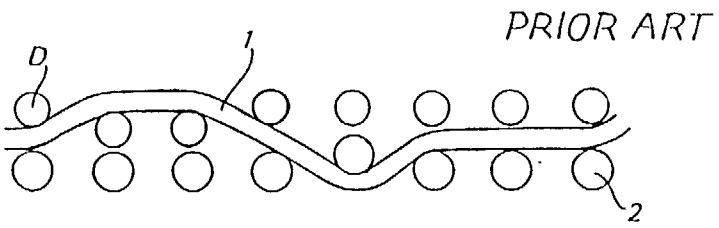
Figure 2:
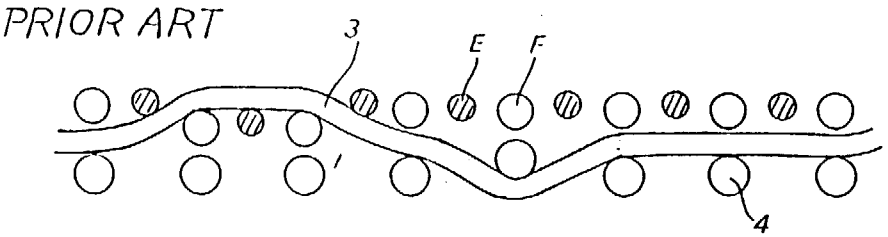
Figure 3:
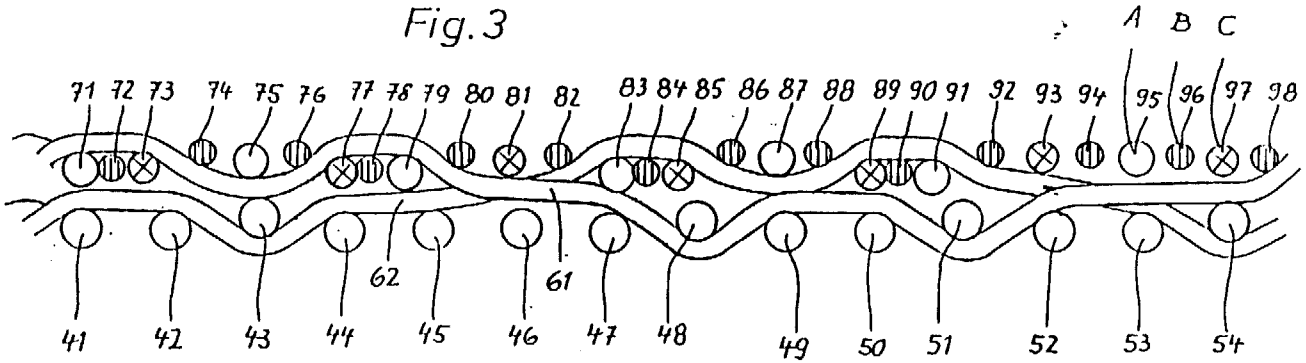
Figure 4:
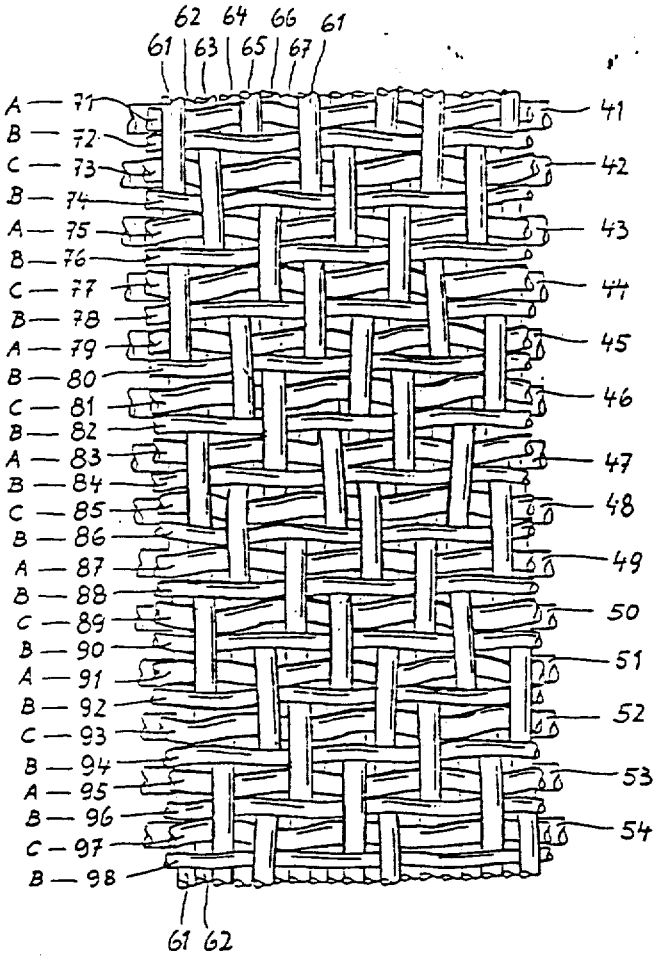
Figure 5:
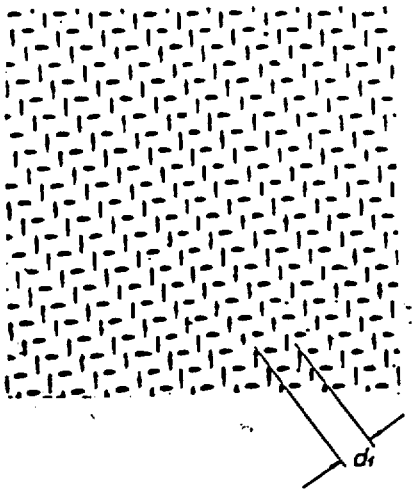
Fig.5 PRIOR ART
Figure 6:
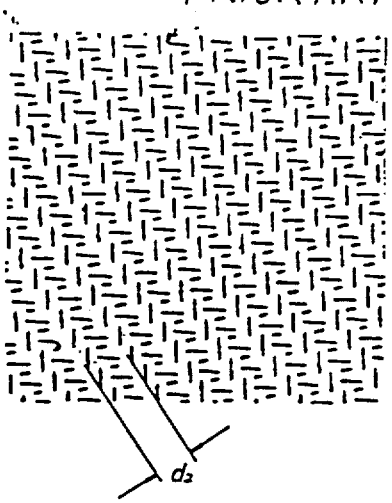
Fig.6 PRIOR ART
Figure 7:
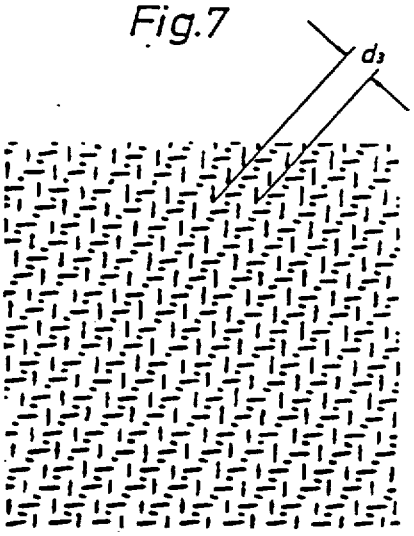

If the known wires according to FIGS. 1 and 2 are compared, with respect to the diagonal distance $d_1$ and $d_2$ of FIGS. 5 and 6, respectively, and with respect to the number of diagonals, approximately fifteen (15), as can be gathered from FIG. 5, and about thirteen (13), as can be gathered from FIG. 6, in contrast to the impression of the paper side of the wires according to the invention as shown by FIG. 7, the diagonal distance d is approximately seventeen (17) diagonals. Thus, the following relationship can be stated: $d_3 > d_2 > d_1$. The impressions of the paper side illustrated by FIGS. 5 through 7 are all enlarged and correspond to an area of 1 $cm^2$. The numbers of the warp threads are about 62/cm.

The embodiment of a wire according to the invention as enclosed in the above comparative table discloses the fact that the number of weft threads per cm should advantageously at least be 60% of their number of the warp threads per cm.

We claim:

1. A double layered papermaking wire comprised of a paper side and a running side;
   - wherein said paper side comprises a set of weft threads;
   - wherein said running side comprises a set of weft threads and a set of warp threads;
   - said set of weft threads on said paper side further comprising three groups of weft threads, A, B and C, said threads differing from one another in material, diameter and floating length in a weave pattern;
   - wherein said weave pattern on said paper side comprises a warp thread crossing over said three succeeding weft threads, thereafter crossing under a succeeding said three succeeding weft threads, thereafter crossing over a succeeding said three succeeding weft threads, thereafter extending between said weft threads on said paper side and said weft threads on said running side and interlacing at least one weft thread on said running side.

2. Papermaking wire according to claim 1, characterized in that said weft threads within the weave pattern on the paper side are arranged such that at those points in which three weft threads of said paper side succeeding one another are crossed over by one of said warp threads, each of said three weft threads belongs to one of said group of weft threads A, B, C, these three weft threads contacting one another at least partly, whereas at those points, in which three weft threads on the paper side succeeding one another are crossed below one of said warp threads, two of said three weft threads belong to the same group of weft threads B and said three weft threads are distantly separated from one another.

3. Papermaking wire according to claim 2, characterized in that each warp thread is displaced with respect to the preceding warp thread by twelve weft threads on the paper side.

4. Papermaking wire according to claim 2, characterized in that each warp thread is displaced with respect to the preceding warp thread by sixteen weft threads on the paper side.

5. Papermaking wire according to claim 2, characterized in that each warp thread within the weave pattern on the paper side is interlaced by two weft threads on said paper side which are not directly succeeding one another, wherein each of these weft threads in within the weave pattern interlaced by only one warp thread.

6. Papermaking wire according to claim 2, characterized in that the number of weft threads per cm wire length of the paper side corresponds to at least 60% of the number of warp threads per cm wire width.

7. Papermaking according to claim 2, characterized in that the three groups of weft threads A, B, C on the paper side are differing from one another with respect to their physical characteristics as length, shrinkage and their thread diameters.

8. Papermaking wire according to claim 2, characterized in that the three groups of weft threads A, B, C on the paper side are differing from one another with respect to their thread diameters.

9. Papermaking wire according to claim 1, characterized in that each warp thread is displaced with respect to the preceding warp thread by twelve cross threads on the paper side.

10. Papermaking wire according to claim 1, characterized in that each warp thread is displaced with respect to the preceding warp thread by sixteen weft threads on the paper side.

11. Papermaking wire according to claim 1, characterized in that the weave pattern includes seven warp threads and forty two weft threads.

12. Papermaking wire according to claim 1, characterized in that each warp thread within the weave pattern on the paper side is interlaced by two weft threads on said paper side which are not directly succeeding one another, wherein each of these weft threads is within the weave pattern interlaced by only one warp thread.

13. Papermaking wire according to claim 1, characterized in that the number of weft threads per cm wire length on the paper side corresponds to at least 60% of the number of warp threads per cm wire width.

14. Papermaking wire according to claim 1, characterized in that the three groups of weft threads A, B, C on the paper side are differing from one another with respect to their physical characteristics as length, shrinkage and their thread diameters.

15. Papermaking wire according to claim 1, characterized in that the three groups of weft threads A, B, C on the paper side are differing from one another with respect to their thread diameters.

* * * * *

UNITED STATES PATENT AND TRADEMARK OFFICE

CERTIFICATE OF CORRECTION

PATENT NO. : 4,998,568

DATED : March 12, 1991

INVENTOR(S) : Fritz Vohringer

It is certified that error appears in the above-identified patent and that said Letters Patent is hereby corrected as shown below:

Title page: The sheets of drawings consisting of figs. 1-7 should be deleted to appear as per attached sheets.

Signed and Sealed this

Twenty-seventh Day of October, 1992

*Attest:*

DOUGLAS B. COMER

*Attesting Officer*

*Acting Commissioner of Patents and Trademarks*